US006715180B2

(12) United States Patent
Mueller et al.

(10) Patent No.: US 6,715,180 B2
(45) Date of Patent: Apr. 6, 2004

(54) CABINET HINGE WITH DEPTH ADJUSTMENT

(75) Inventors: Wolfgang Mueller, Lustenau (AT); Markus Albrecht, Lustenau (AT); Remo Egger, Bregenz (AT); Holger Wenzel, Weibensberg (DE)

(73) Assignee: Grass GmbH, Voralberg (AT)

( * ) Notice: Subject to any disclaimer, the term of this patent is extended or adjusted under 35 U.S.C. 154(b) by 0 days.

(21) Appl. No.: 10/230,624

(22) Filed: Aug. 29, 2002

(65) Prior Publication Data

US 2003/0041412 A1 Mar. 6, 2003

(30) Foreign Application Priority Data

Aug. 31, 2001 (EP) ..... 01120958

(51) Int. Cl.[7] ..... E05D 7/04

(52) U.S. Cl. ..... 16/236; 16/242; 16/382; 16/245

(58) Field of Search ..... 16/236, 237, 245, 16/246, 249, 238, 240, 242, 382

(56) References Cited

U.S. PATENT DOCUMENTS

| | | | | |
|---|---|---|---|---|
| 4,558,485 A | | 12/1985 | Rock et al. | |
| 4,590,641 A | | 5/1986 | Lautenschlager et al. | |
| 4,654,932 A | | 4/1987 | Rock et al. | |
| 4,691,408 A | | 9/1987 | Rock et al. | |
| 4,976,006 A | | 12/1990 | Lautenschlager | |
| 5,022,116 A | | 6/1991 | Salice | |
| 5,025,530 A | | 6/1991 | Ferrari et al. | |
| 5,036,565 A | | 8/1991 | Salice | |
| 5,056,189 A | | 10/1991 | Brustle et al. | |
| 5,062,180 A | | 11/1991 | Lautenschlager, Jr. | |
| 5,210,907 A | | 5/1993 | Toyama | |
| 5,245,727 A | | 9/1993 | Sasaki | |
| 5,257,437 A | | 11/1993 | Salice | |
| 5,412,840 A | | 5/1995 | Lautenschlager et al. | |
| 5,511,287 A | | 4/1996 | Lautenschlager et al. | |
| 5,577,297 A | | 11/1996 | Lautenschlager et al. | |
| 5,964,010 A | * | 10/1999 | Huber | 16/237 |
| 5,964,011 A | * | 10/1999 | Ruston et al. | 16/239 |
| 6,032,333 A | * | 3/2000 | Brustle | 16/242 |
| 6,061,872 A | | 5/2000 | Albrecht et al. | |
| 6,339,864 B1 | | 1/2002 | Albrecht et al. | |
| 6,523,225 B1 | * | 2/2003 | Pecar | 16/382 |

FOREIGN PATENT DOCUMENTS

| | | | |
|---|---|---|---|
| DE | 3348339 C2 | * | 7/1992 |
| DE | 298 11 793 | | 12/1999 |
| DE | 299 14 473 | | 2/2000 |
| EP | 0 969 173 | | 1/2000 |
| EP | 1236853 A2 | * | 2/2002 |
| JP | 8-210011 | * | 8/1996 |

* cited by examiner

*Primary Examiner*—Chuck Y. Mah
(74) *Attorney, Agent, or Firm*—John M. Harrington; Kilpatrick Stockton LLP

(57) ABSTRACT

The invention concerns a cabinet hinge with a depth adjusting device for hinge arm held directly or indirectly on a cabinet-side, single- or multi-part mounting plate. A revolvable depth adjusting screw held in the mounting plate is provided in order to adjust the depth. A driver plate is connected with the hinge arm; whereby, the depth adjusting screw has adjusting elements that work together with corresponding adjusting surfaces on the driver plate in such a way that by turning the depth adjusting screw, the driver plate and the hinge arm are moved in relation to the mounting plate. The invention offers the advantage that with only turn, the depth adjusting screw can finely and delicately adjust the depth position of the hinge arm over its entire adjustment range.

9 Claims, 3 Drawing Sheets

FIG. 7
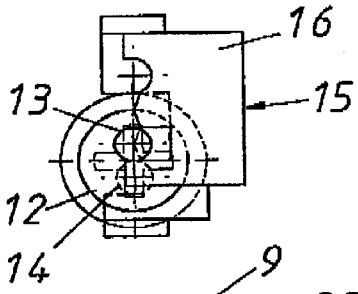
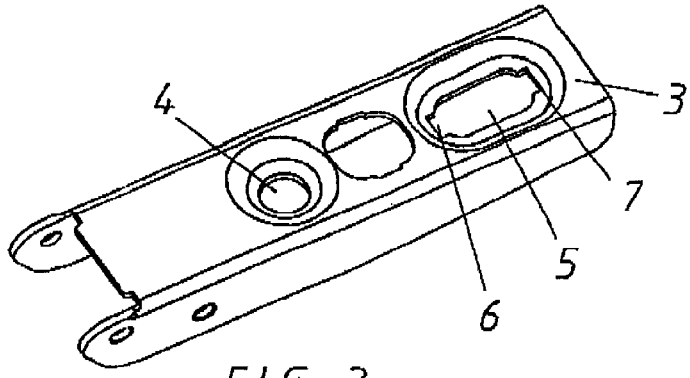
FIG. 3
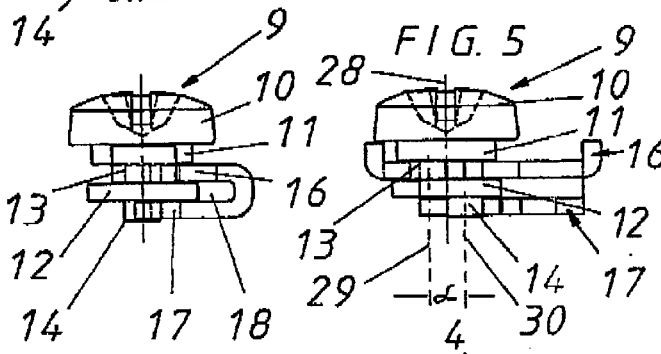
FIG. 5
FIG. 6
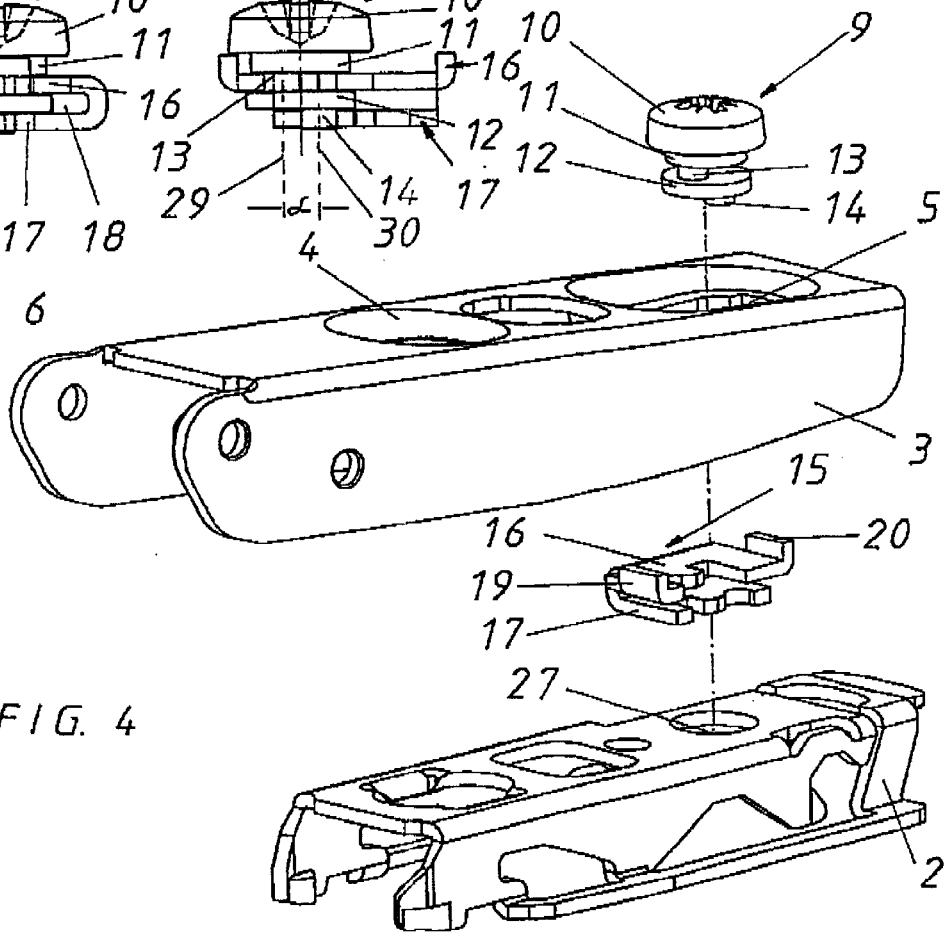
FIG. 4

0° Stellung

90° Stellung

180° Stellung

270° Stellung

360° Stellung

CABINET HINGE WITH DEPTH ADJUSTMENT

FIELD OF THE INVENTION

The invention concerns a cabinet hinge with a depth adjusting device that connects directly or indirectly on a cabinet-side, single- or multi-part mounting plate holding a hinge arm, according to the introductory or characterizing clause of Patent claim 1.

BACKGROUND OF THE INVENTION

In general, various adjustments are possible with cabinet hinges.

Thus, one adjustment possibility is the depth adjustment of the hinge arm by which the cabinet door's distance can be adjusted to the front side of the cabinet. The depth adjustment is generally achieved by a clamping screw that fastens the hinge arm to the mounting plate.

The clamping screw projects through an elongated hole in the hinge arm so that the depth adjustment takes place by gliding along the elongated hole; the adjustment is determined by the length of the elongated hole. The disadvantage here is that the depth adjusting screw must be loosened in order to make the sliding along the elongated hole possible. A delicate adjustment with this type of system is just not possible.

The document DE-U-299 14 473 makes known a cabinet hinge with the depth adjustment based on a (check) pinion. Along the fixed mounting plate of the cabinet hinge, several arched tooth segments are arranged in a distance parallel to each other. Together with these tooth segments, a spiral-shaped projection works with a revolvable depth adjusting screw that is held in the hinge arm.

By turning the screw, the projection engages in the tooth segments, one after the other, so that the hinge arm slides along the mounting plate. Large and small adjustments can be accomplished with this system, but there is still the disadvantage utilize the entire adjustment range, it is necessary to turn the adjusting screw several times.

SUMMARY OF THE INVENTION

It is the task of the invention to declare a cabinet hinge that can achieve a large depth adjustment that can be accomplished with just one turn of the depth adjusting screw. Furthermore, the depth adjusting screw's operation should be smooth, however, excluding an independent adjustment of the depth position.

This task is solved by the features and characteristics cited in Patent Claim 1.

The formulated features of the invention are given in the independent and individual Patent Claims.

The invention is based on a cabinet hinge with a driver plate that is connected to the hinge arm; whereby, the depth adjusting screw has adjusting elements that work together with corresponding adjusting surfaces on the driver plate so that when the depth adjusting screw is turned, the driver plate and the hinge arm are moved in relation to the mounting plate.

In a preferred embodiment of the invention, the driver plate is formed in the cross section somewhat unshaped, and has an upper and a lower driver shank that are connected on a side edge to each other. Parts of the adjusting screw are placed on or, respectively, in the driver plate.

According to the invention, it is furthermore intended that the adjusting surfaces are formed from the free side edge of the driver shank and always has a driver slot and an adjoining merging rolling surface in a stop bay. The adjusting surfaces of the driver shank are formed so that the driver slot of one of the driver shanks lies opposite the stop bay of the other driver shank and vice versa.

The adjusting elements are, preferably, made of two crank pins located at opposite sides of a concentric crank disk. The crank pins are placed about 180° to each other and run parallel to the lengthwise axis of the crank disk so that the lengthwise axis is level.

It is provided that the upper crank pin of the driver's shank's adjusting surface corresponds to the lower crank disk of the driver's shank's adjusting surface. So only one crank pin engages in the corresponding driver slot, while the other crank pin lies on the corresponding rolling surface or stop bay.

In order to fix the position of the depth adjusting screw, the crank disk is accepted into a bore hole of the adjusting plate. The driver plate, however, is held movable on the adjusting plate so that the crank disk and part of the adjusting plate are located in the space or gap between the driver shanks.

In order for the hinge arm of the driver plate to be retained, the upper driver shank, preferably, has upward projecting brackets that engage in the corresponding recesses of the hinge arm.

The maximum depth adjustment that can be achieved, results from the doubled distance of the crank pins to each other. Consequently, a single turn of the depth adjusting screw results in a maximum depth adjustment of over 360°.

The invention offers the advantage that with only a single turn of the depth adjusting screw, a delicate adjusting of the depth position of the hinge arm can be undertaken with its entire adjustment range. The proposed depth adjustment is smooth and excludes an independent adjustment of the set position (that is, prevents an independent unintentional adjustment).

An implementation example of the invention will be more closely described based on the presented drawn figures. Further features, characteristics, advantages, uses and applications follow from the drawings and following descriptions.

BRIEF DESCRIPTION OF THE DRAWINGS

FIG. 3: a perspective view of the hinge arm;

FIG. 4: an exploded representation of the hinge elements that form the depth adjusting device or hinge elements that work together with them;

FIG. 5: a longitudinal section through the driver plate and the depth adjusting screw;

FIG. 6: a cross section through the driver plate and the depth adjusting screw;

FIG. 7: an overview of the driver plate and the depth adjusting screw;

DETAILED DESCRIPTION

Figure 1:
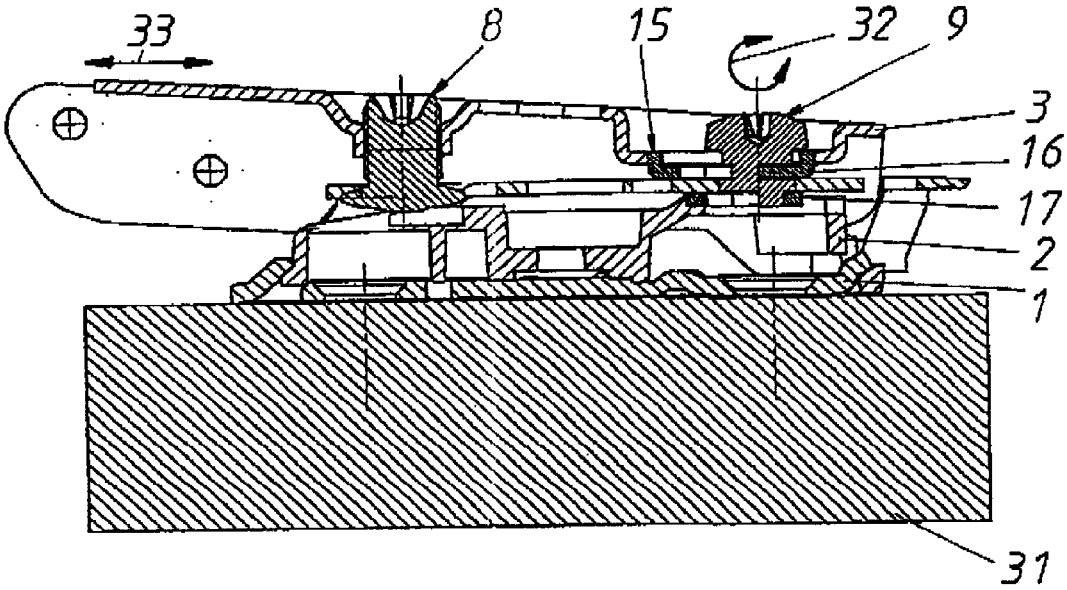
FIG. 1: a longitudinal section through the cabinet hinge with depth adjusting device in the front final position of the hinge arm.
Figure 2:
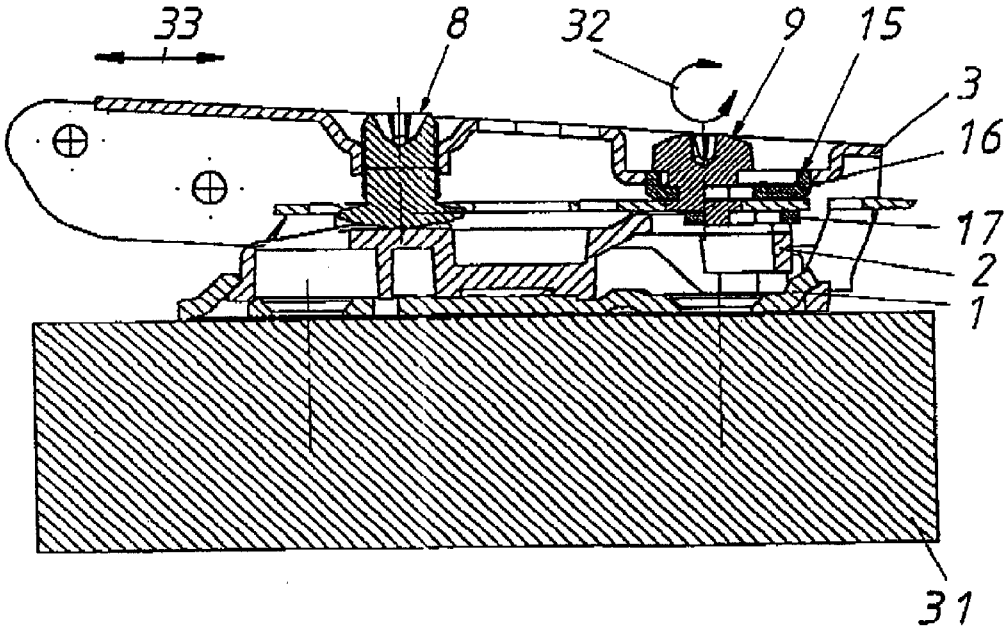
FIG. 2: a longitudinal section through the cabinet hinge with depth adjusting device in the back final position of the hinge arm.

FIGS. 1 and 2 show the basic design of the invention-related cabinet hinge. The cabinet hinge includes a mounting plate that consists of a baseplate (1) and an adjusting plate (2), so that the baseplate (1) is fastened to the side wall of a cabinet component (31). The adjusting plate (2) can be connected, lockable and removable, with the baseplate (1). A hinge arm (3) is fastened on the adjusting plate (2), which is connected, as shown in the drawing, continuing left and is connected jointed or hinged with a door-side stop component (for example, a hinge cup that is not pictured) that is recessed or embedded in a cabinet door (not pictured).

In order to adjust the cabinet door laterally (that is, the hinge arm is adjusted in the perpendicular direction to the mounting level or, respectively, the baseplate), a side adjusting screw (8) is provided. The depth adjustment, that is, the adjustment of the hinge arm (3) parallel to the baseplate (1), results by means of a depth adjusting screw (9); that is, the adjusting plate (2) is, preferably, stored revolvable in the mounting plate.

The depth adjusting screw (9), together with a driver plate (15), is connected to the hinge arm (3) so that the depth adjusting screw (9) has adjusting elements that work together with corresponding adjusting surfaces on the driver plate (15) of this type, which, by turning the depth adjusting screw (9) in the arrow direction (32), the driver plate (15) and the hinge arm (3) are moved in relation to the mounting plate (1,2) in arrow direction (33). The maximum possible adjustment of the depth adjustment is defined by the distance.

The driver plate includes an upper driver shank (16) that comes to lie between the hinge arm (3) and the adjusting plate (2) and the lower driver shank (17) that lies between the adjusting plate (2) and the baseplate (1).

FIG. 4 shows the construction of the depth adjusting device in detail. The depth adjusting screw (9) includes a screw head (10) with an adjoining collar (11) and an upper crank pin (13) that is located eccentric to the screw's (9) longitudinal middle axis. A crank disk (12) adjoins the upper crank pin (13) and is located in turn concentric to the screw's longitudinal middle axis. Finally the screw (9) includes a lower crank pin that is located eccentric to the screw's longitudinal middle axis and is placed opposite the upper crank pins (13) approximately 180°.

The driver plate (15) includes an upper driver shank (16) and a lower driver shank (17), that are connected at their side edges with each other, resulting in the cross-section with a somewhat u-shaped part. Upward pointed brackets (19, 20) are provided on the upper driver shank.

The hinge arm includes, according to FIG. 3, a front opening (4) in which the side adjusting screw is stored, and a back elongated-shaped opening (5) that has recesses (6, 7) on its longitudinal ends. The depth adjusting screw (9) is inserted in the opening (5). As shown in FIGS. 3 and 4 in connection to the FIGS. 1 and 2, the crank disk (12) sits in a bore hole (27) of the adjusting plate (2).

The driver plate (15) is shifted in this way on the surface of the adjusting plate (2), so that the upper driver shank above the adjusting plate (2) and the lower driver shank (17) below the adjusting plate (2) come to rest so that the crank disk (12) is received in the gap (18) between the shanks (16, 17). The upper crank pin (13) then lies on the irregular adjusting surface of the upper driver shank (16), against which the lower crank pin (14) lies on the adjusting surface of the lower driver shank (17).

Now the hinge arm (3) can be placed on it, so that the depth adjusting screw (9) engages through the elongated hole (5) of the hinge arm and lies with its collar (11) on the elongated hole edge. The brackets (19, 20) of the driver plate (15) engage in the recesses (6, 7) of the elongated hole (5).

FIGS. 5 to 7 again show in all three views the depth adjusting screw (9) inserted in the driver plate (15). The crank plate (12) is shown that is taken up between the driver shanks (16 and 17) and the crank pins (13, 14) that lie on the free edge of the driver shank (16, 17). The crank pins (13, 14) have a mutual distance d so that the maximum depth adjustment range s corresponds to the doubled distance d, that will be, subsequently, more closely described. The longitudinal middle axes (28 to 30) of the depth adjusting screw (9) and the crank pins (13 and 14) run parallel to one another and level.

Based on FIGS. 8 to 17, the operational or functional method of the depth adjusting device is now described. It is important that the driver plate (15) is connected securely to the hinge arm (3) because the brackets (19, 20) engage in the corresponding recesses of the hinge arm (3); whereas, however, the depth adjusting screw (9), that, here, has the crank plate (12) and the crank pins (13 and 14), is held securely in the bore hole (27) of the adjusting plate (2). When the depth adjusting screw (9) is turned, the screw itself does not shift or move; instead, the driver plate (15) shifts or slides against the depth adjusting screw (9) and with it, the hinge arm (3).

Figure 8:
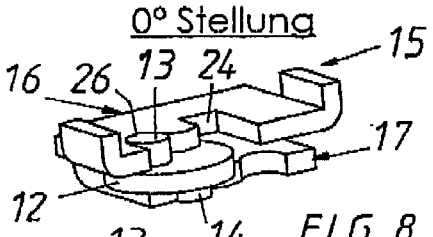
FIG. 8: a perspective view from above of the driver plate and the depth adjusting screw in the 0° position.
Figure 9:
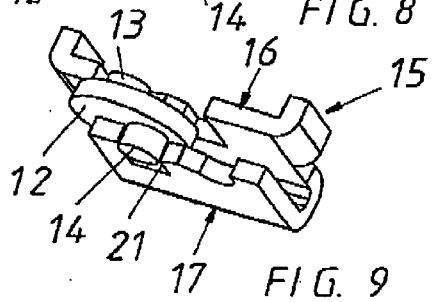
FIG. 9: a perspective view from below of the driver plate and the depth adjusting screw in the 0° position.

FIGS. 8 and 9 show the depth adjusting device in its starting position (that is the 0° position). Here the lower crank pin (14) is engaged with a driver slot (21), that is formed on the lower driver shank (17). The upper crank pin (13) lies in a stop bay (26) that is part of the upper driver shank (16).

Figure 10:
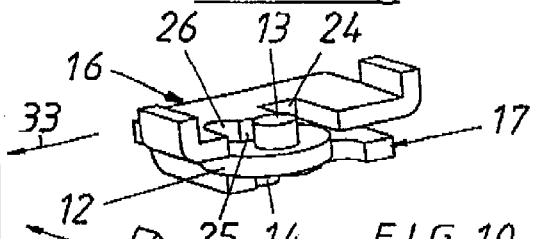
FIG. 10: a perspective view from above of the driver plate and the depth adjusting screw in the 90° position.
Figure 11:
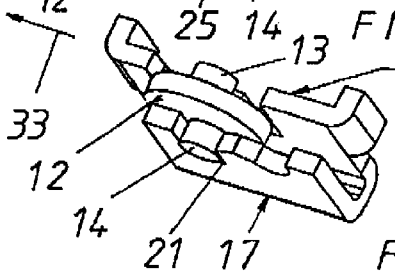
FIG. 11: a perspective view from below of the driver plate and the depth adjusting screw in the 90° position.

If the depth adjusting screw (9) is turned counterclockwise, the crank plate (12) and the crank pins (13, 14) fastened to it, turn with it. FIGS. 10 and 11 show the 90° position, the lower crank pin is always still engaged with the driver slot (21); whereas, the upper crank pin (13) runs freely and is not engaged with the adjusting surfaces (24 to 26) of the upper driver shank (16). By this, the driver plate (15) is taken from the lower crank pin (14) and moves towards the front in the given arrow direction (33). The crank pin (13) runs freely along the running surface (25) in the direction of the upper driver slot (24).

Figure 12:
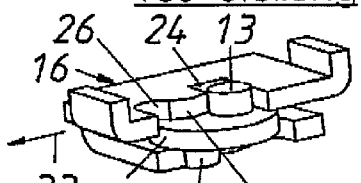
FIG. 12: a perspective view from above of the driver plate and the depth adjusting screw in the 180° position.
Figure 13:
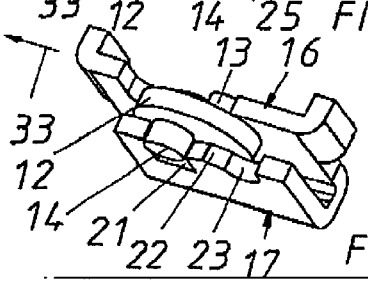
FIG. 13: a perspective view from below of the driver plate and the depth adjusting screw in the 180° position.

With a turn of 180°, according to FIGS. 12 and 13, the lower crank pin (14) is still always engaged with the lower driver slot (21) and transports the driver plate (15) in arrow direction (33). The upper crank pin (13) now moves along the running surface (25) and then comes into the area of the upper driver slot (24) and engages in it. Simultaneously, the lower crank pin (14) swings out and then out of the driver slot (21).

Figure 14:
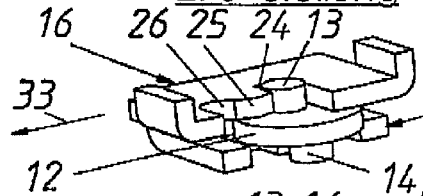
FIG. 14: a perspective view from above of the driver plate and the depth adjusting screw in the 270° position.
Figure 15:
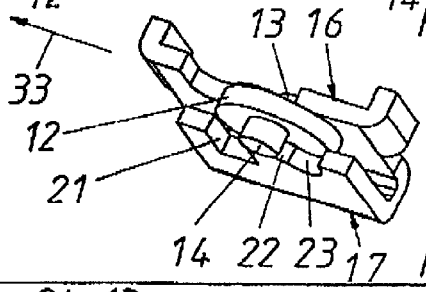
FIG. 15: a perspective view from below of the driver plate and the depth adjusting screw in the 270° position.

If one turns further to the 270° position, as shown in FIGS. 14 and 15, one sees that the lower crank pin (14) now runs along the lower rolling surface (22); whereas, the upper crank pin is always engaged with the upper driver slot (24) and the driver plate (15) is transported further in arrow direction (33).

Figure 16:
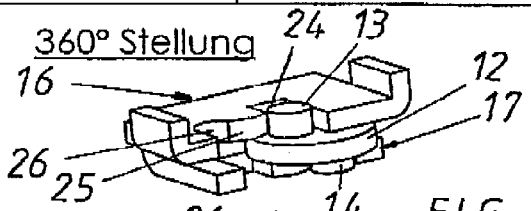
FIG. 16: a perspective view from above of the driver plate and the depth adjusting screw in the 360° position.
Figure 17:
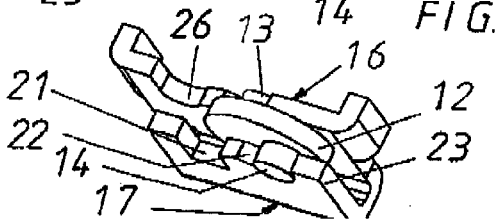
FIG. 17: a perspective view from below of the driver plate and the depth adjusting screw in the 360° position.

Finally, in the 360° end position, FIGS. 16 and 17 show the upper crank pin is still in the driver slot (24) and has, until now, transported the driver plate (15); whereas, the lower crank pin (14) has run along the lower rolling surface (22) and has now stopped in the lower stop bay (23).

As one can see, the driver plate (15) with a complete turn of the depth adjusting screw (9) is continually transported by the crank pins (13 and 14) in arrow direction (33). Thus, the driver plate (15) is transported over the first half of the adjustment s from the lower crank pin (14) and over the other half of the adjustment s by the upper crank pin (13). The total adjustments correspond, therefore, to double the distance d of the crank pins (13, 14) because each crank pin is transported over a distance that corresponds to the distance d.

Drawing Legend

1 Baseplate
2 Adjusting plate
3 Hinge arm
4 Opening
5 Elongated hole
6 Recess
7 Recess
8 Side adjusting screw
9 Depth adjusting screw
10 Screw head
11 Collar
12 Crank disk
13 Crank pin (upper)
14 Crank pin (lower)
15 Driver plate
16 Driver shank (upper)
17 Driver shank (lower)
18 Gap
19 Bracket
20 Bracket
21 Driver slot (lower)
22 Rolling surface
23 Stop bay
24 Driver slot (upper)
25 Rolling surface
26 Stop bay
27 Bore hole
28 Axis
29 Axis
30 Axis
31 Cabinet component
32 Arrow direction
33 Arrow direction

What is claimed is:

1. Cabinet hinge with a depth adjusting device a mountable on a cabinet, comprising:

a mounting plate;

a hinge arm, supported on the mounting plate;

a driver plate that is connected to the hinge arm;

a revolvable depth adjusting screw received in the mounting plate and having a longitudinal axis; and a plurality of spaced-apart adjusting elements disposed on the adjusting screw eccentric to the longitudinal axis of the adjusting screw that cooperatively engage corresponding adjusting surfaces on the driver plate, so that by turning the depth adjusting screw, the driver plate and the hinge arm are shifted in relation to the mounting plate.

2. Cabinet hinge according to claim 1, wherein the driver plate is formed in a substantially U-shaped cross-section and has an upper and a lower driver shank that are connected together at a side edge, each driver shank having an opposite side edge that is free.

3. Cabinet hinge according to claim 2, wherein the corresponding adjusting surfaces on the driver plate are formed on the free side edge of each driver shank and wherein each corresponding adjusting surface further comprises a driver slot, an adjoining merging rolling surface, and a stop bay; whereby, the driver slots and stop bays of the respective driver shanks are located opposite each other.

4. Cabinet hinge, according to claim 3, wherein the adjusting elements of the adjusting screw further comprise two crank pins, each having a central axis and located at opposite sides of a concentric crank disk of the adjusting screw, the crank disk also having a central axis, that are placed about 180° to each other and whose central axes run parallel to the central axis of the crank disk, so that the central axes of the crank pins are parallel to one another.

5. Cabinet hinge, according to claim 4, wherein the two crank pins further comprise an upper crank pin engaging the adjusting surface of the upper driver shank and a lower crank pin engaging the adjusting surface of the lower driver shank; whereby when one of the crank pins engages in the driver slot of one of the adjusting surfaces, the other crank pin lies on one of the running surface and the stop bay of the other of the adjusting surfaces.

6. Cabinet hinge, according to claim 5, wherein the crank disk of the adjusting screw is received in a bore hole formed in the adjusting plate.

7. Cabinet hinge, according to claim 6, wherein the driver plate is held movable on the adjusting plate; whereby, the crank disk of the adjusting screw and portions of the adjusting plate adjacent the bore hole formed in the adjusting plate are located in a gap defined between the driver shanks of the driver plate.

8. Cabinet hinge, according to claim 7, wherein the upper driver shank of the driver plate has upward projecting brackets that engage in corresponding recesses formed in the hinge arm.

9. Cabinet hinge, according to claim 8, wherein a single revolution of the revolvable depth adjusting screw corresponds to over 360° of a maximum shift of the driver plate and the hinge arm in relation to the mounting plate.

* * * * *

UNITED STATES PATENT AND TRADEMARK OFFICE

CERTIFICATE OF CORRECTION

PATENT NO. : 6,715,180 B2
DATED : April 6, 2004
INVENTOR(S) : Wolfgang Mueller et al.

It is certified that error appears in the above-identified patent and that said Letters Patent is hereby corrected as shown below:

Column 1,
Line 64, reads "plate is formed in the cross section somewhat unshaped,"
should read -- plate is formed in the cross section somewhat u-shaped, --

Column 3,
Line 29, reads "is connected, as shown in the drawing, continuing left and is"
should read -- [the hinge arm] is connected, as shown in the drawing, continuing left and is -- .
Line 34, reads "hinge arm is adjusted in the perpendicular direction to the" should read -- hinge arm [3] is adjusted in the perpendicular direction to the --.
Line 35, reads "mounting level or, respectively, the baseplate), a side adjust-" should read -- mounting level or, respectively, the baseplate [1]), a side adjust- --.
Lines 49-50, reads "adjustment of the depth adjustment is defined by the distance."
should read -- adjustment of the depth adjustment is defined adjustment is defined by the distance s. --

Signed and Sealed this

Thirteenth Day of July, 2004

JON W. DUDAS
*Acting Director of the United States Patent and Trademark Office*